United States Patent [19]

Namba

[11] Patent Number: 4,548,402

[45] Date of Patent: Oct. 22, 1985

[54] PAPER SORTING APPARATUS FOR A COPIER

[75] Inventor: Yoshiharu Namba, Ebina, Japan

[73] Assignee: Rank Xerox Limited, London, England

[21] Appl. No.: 556,753

[22] Filed: Nov. 30, 1983

[51] Int. Cl.[4] ..... B65H 29/58

[52] U.S. Cl. ..... 271/290; 271/291

[58] Field of Search ..... 271/290, 291, 296, 297, 271/305

[56] References Cited

U.S. PATENT DOCUMENTS

| | | | |
|---|---|---|---|
| 3,343,672 | 9/1967 | DeVries | 271/305 X |
| 3,750,880 | 8/1973 | Petrovsky | 271/305 X |
| 3,848,868 | 11/1974 | Stemmle | 271/296 X |
| 4,228,995 | 10/1980 | Bruers | 271/291 X |

OTHER PUBLICATIONS

IBM Technical Disclosure Bulletin, vol. 18, No. 7, pp. 2071, 2072, Dec. 1975, "Two-Module Collator", M. D. Avritt.

*Primary Examiner*—Richard A. Schacher

*Attorney, Agent, or Firm*—Bernard A. Chiama

[57] ABSTRACT

A sheet sorter apparatus is disclosed as having a basic sorter unit comprising a horizontal transport, a vertical transport, and a plurality of sorter bins wherein the vertical transport has a pair of bin indexing guide elements, one of which is arranged to index sheets into the bins sequentially, while the other element is arranged to index sheets to a second sorter unit containing only a plurality of bins thereby allowing the use of additional bins without added transport structure.

3 Claims, 9 Drawing Figures

PAPER SORTING APPARATUS FOR A COPIER

This invention relates to an improvement to a paper sorting apparatus for use with a copier or the like.

Figure 1:
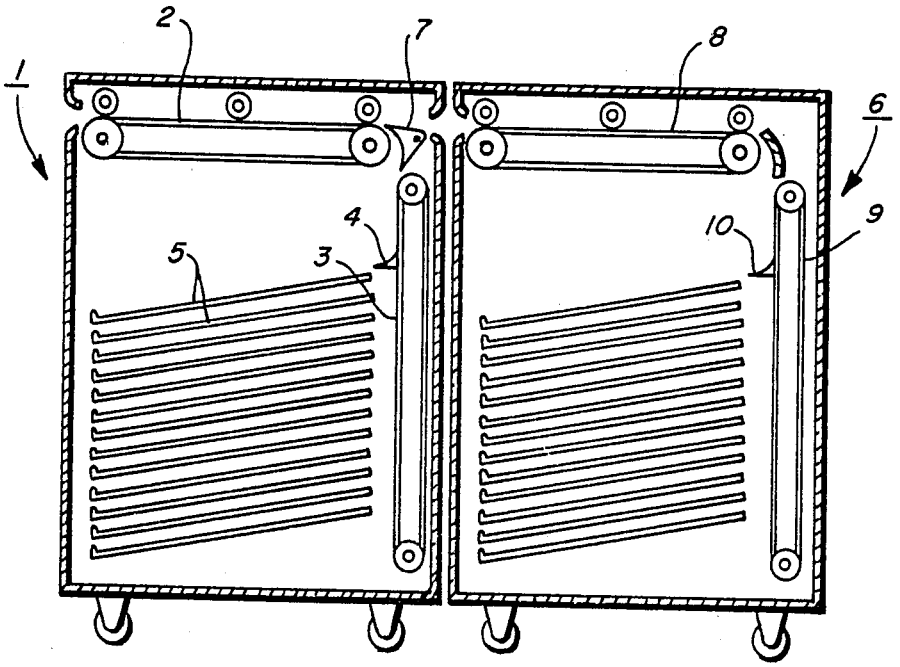
FIGS. 1 and 2 are elevational views in cross-section of conventional sorters coupled together in order to expand sorting quantity.

As illustrated in FIG. 1, in a conventional single array sorter having a predetermined number of bins applied to an electrophotographic copier or duplicator, if the sorter is short of bins, generally, a similar array is added by coupling to the first sorter so as to double the number of bins. For example, in FIG. 1, a sorter array 1 comprises a horizontal transport 2 for horizontally transporting paper, a vertical transport 3, a deflector gate 4 for determining the sorting position, and a plurality of bins 5 functioning as paper storing portions. The number of the bins is properly increased by coupling one or more sorter arrays 6 to each other and providing the coupling portion of both sorters with paper path switching means 7.

In this system, however, the number of bins is increased by additionally using the same type of sorter 6, so that each sorter requires a horizontal transport 8, a vertical transport 9, and a deflector gate 10, which results in various disadvantages in that the manufacturing cost and the installation space are doubled. In addition, power consumption and noise during operation are doubled.

Figure 2:
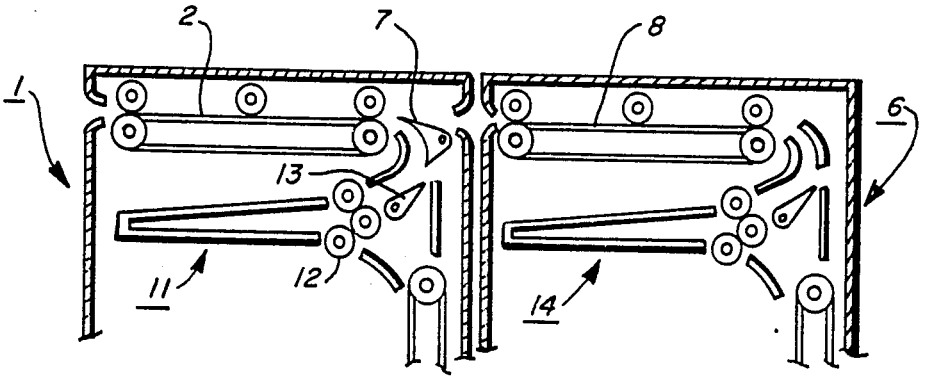
Figure 3:
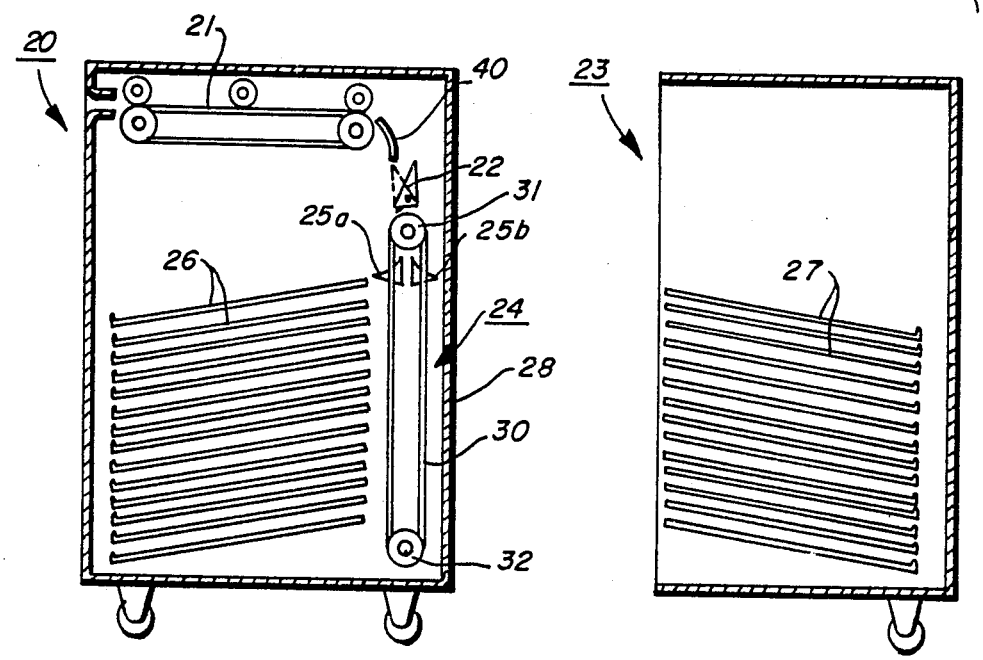
FIG. 3 is an elevation view in cross secton showing one embodiment of a basic sorter array and an additional bin array according to the present invention.

As shown in FIG. 2, if the sorter 1 is provided with a paper inverting device 11 comprising an inverter triroller set 12 and an inverting guide 13, additional similar sorters 6 being coupled to each other in the same manner as shown in FIG. 1, the additional paper inverting device 14 mounted on each sorter 6, also adds high costs to the system.

The present invention relates to the improvement in a paper sorting apparatus for a copier or duplicator which has overcome such disadvantages. It is an object of the invention to provide a sorter which can use a sheet transport and a bin deflector gate in common with other like sorters, so that to increase the number of bins by coupling two sorter arrays comprising a basic sorter and an additional sorter unit, maufacturing cost and operation will remain low and installation space can be reduced.

The present invention will now be described by way of the embodiments illustrated in FIGS. 3 to 7.

A basic sorter array 20 comprises a horizontal transport 21 for horizontally transporting paper, a paper path switching device 22 adapted to selectively change the peper path over to the basic sorter array 20 or to an additional bin array 23, a vertical transport 24 perpendicularly disposed below the paper path switching device 23, a two-way sheet diverter gate 25*a* and 25*b* capable of determining the sorting position in right and left, two directions, and a plurality of bins 26 with respect to the sorter 21 and bins 27 with respect to the sorter 23, disposed vertically.

The additional bin array 23 is provided only with a plurality of bins 27 disposed vertically, but not with a horizontal transport or vertical transport and a diverter gate.

The papaer sorting system of the invention is constructed by detaching the right side cover 28 of the basic sorter array 20, and coupling the basic sorter and the additional bin array 27 in a common body.

The paper path switching device 22 mounted in the basic sorter array 20 is operated by a solenoid. When the paper path switching device 22 inclines to the right (position indicated by a solid line) in FIG. 4, paper is sorted to the bins 26 of the basic sorter array 20 and when it inclines to the left (position indicated by a dashed line), paper is sorted to the bins 27 of the additional bin array 23.

Figure 4:
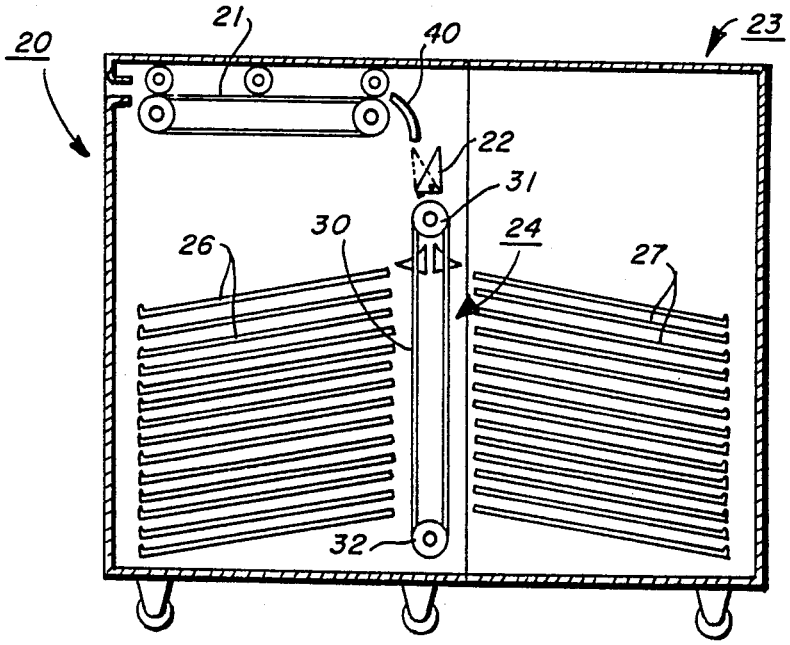
FIG. 4 is an elevational view in cross section of the basic sorter array and the additional bin array of FIG. 3 coupled to each other.
Figure 5:
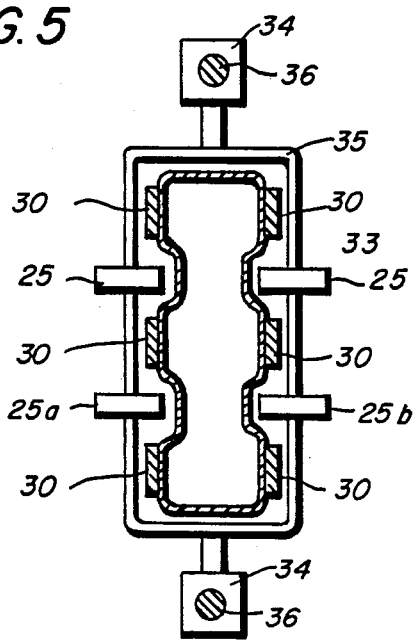
FIGS. 5–7 are detailed views of the vertical transport station and the diverter gates utilized in the sorter in FIG. 4.
Figure 6:
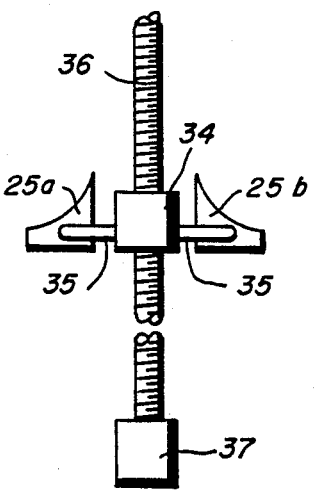
Figure 7:
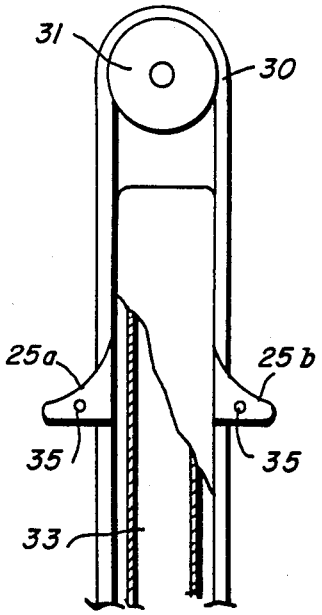

The vertical transport 24, as shown in FIGS 4–6, comprises a plurality of belts 30 stretched between a rotating and reversing motor 31 and a pulley 32, wherein the belts 30 are adapted to slide across a vacuum chamber 33 (see FIGS. 5 and 7). A fan (not shown) is disposed in the vacuum chamber 33, and the outer wall of the vacuum chamber 33 has a plurality of suction holes formed on a portion thereof contacting the belts 30. The belts 30 are also provided with suitable holes which cooperate with the holes on the walls of the chamber 33. Accordingly, the outside air is drawn from the belts 30 and into the outer wall of the vacuum chamber 33 so that a force is produced for holding paper applied to the belts 30.

The right and left diverter gates 25*a* and 25*b* are fixed to blocks 34 wherein screw threads are formed and which are supported by a frame member 35. The blocks 34 are engaged with a screw rod 36 arranged to drive the gates 25*a* and 25*b* vertically in either direction.

A driving motor 37 is fitted to one end of the screw rod 36 so that when the screw rod 36 is rotated, the blocks 34 are moved up or down, which causes the right and left diverter gates 25*a* and 25*b* to move up and down, accordingly.

In the event the number of bins of the basic sorter array 20 and the number or bins of the additional bin array 23 are respectively 20 by way of example, when the required copy number is 20 or less, only the basic sorter array 20 is used. If the required copy number is from 21 to 40 both inclusive, by a signal for the copy number preset on the copier programmer body (not shown) at a point of time when the number of copies made from the same documents amounts to 21 or more, the paper path switching device 22 is changed over to bring into use the additional bin array 23. That is, when the required copy number is 20 or less, paper transported from the copier to the basic sorter array 20 is further transported by the horizontal transport 21, guided by a paper guide 40, passed through the paper path switching device 22 inclined to the right (position indicated by a solid line) in FIG. 4, drawn to the left side of the belt 30 in the vertical transport 24, and further transported downward by forward rotation of the rotating and reversing motor 32 to be sorted to the bins 26 by the left indexer 25*a*.

If the required copy number is 21 or more, the paper path switching device 22 is inclined to the left (position indicated by a dashed line) in FIG. 4, and simultaneously the vertical transport 24 is rotated backward, so that paper is drawn to the right side of the belt 30 in the vertical transport 24, and further transported downward to be sorted to the bins 27 by the right indexer 25*b*.

In the embodiment illustrated in FIG. 4, the main body of the copier incorporates a paper inverter, and in cooperation with each operation of the described sorter array and the addition of bin array 23, the described inverter is used or not used if the number of copies made for the same document is 20 or less, or if it is 21 or more. For example, with a copier where paper is fed out, with the copy surface up, in case of sequentially making copies from one page to the last page, if the copy number for the same document is 20 or less, the paper inverter is not used, and copies are sorted to the bins 26 of the basic sorter array 20. When the copy number is over 21, paper is inverted by the paper inverter to be fed out, with the copy surface down, and sorted to the bins 27 of the additional bin array 23, wherein in either case, paper is sorted to the bins 26 or 27 with the copy surface down. At the time of duplex copying operation, the described inverter operation may be reversed.

Figure 8:
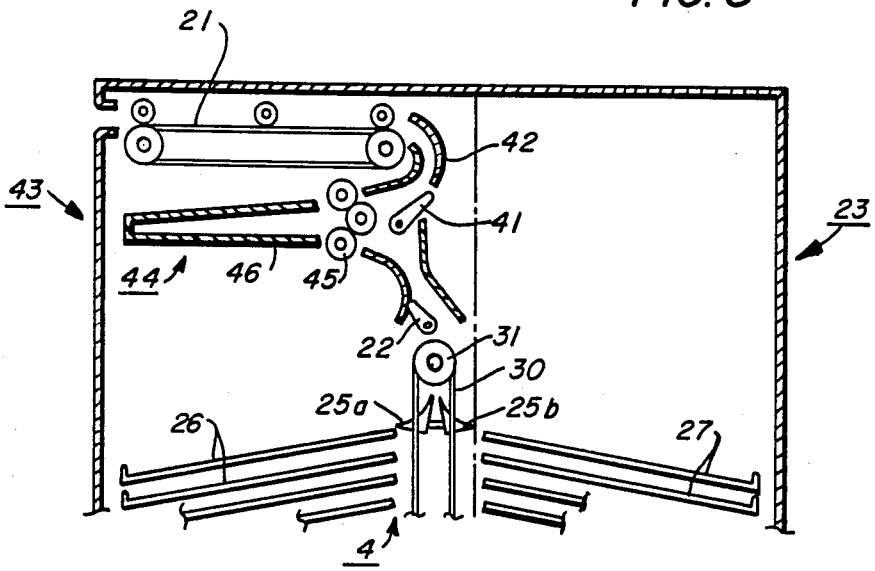
FIGS. 8 and 9 are side views in cross section showing embodiments where a paper inverter is fixed to the embodiment shown in FIG. 4.
Figure 9:
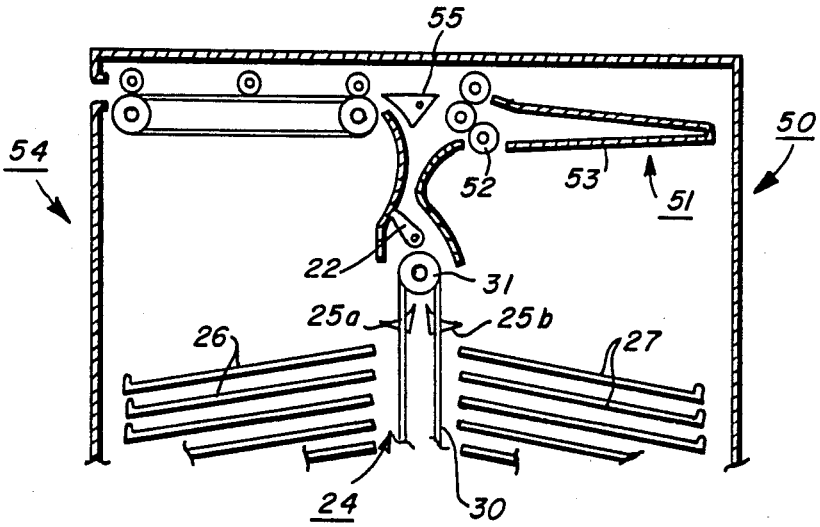

If the main body of the copier is not provided with an inverter for inverting paper, as illustrated in FIGS. 8 and 9, it is necessary to provide the paper inverter in the basic sorter array 20 or the additional bin array 23.

In FIG. 8, a paper path switching device 41 is disposed below a paper guide 42 of a basic sorter array 43, a paper inverter 44 comprising an inverter tri-roller set 45 and an inverting guide 46 is disposed in the vicinty of the paper path switching device 41, and in the same manner as the embodiment illustrated in FIG. 4. The paper path switching device 22, the vertical transport 4, the deflector gates 25*a* and 25*b* and so on are common to the two embodiments.

In FIG. 9, an additional bin array 50 is provided with a paper inverter 51 comprising an inverter tri-roller set 52 and the inverting guide 53, which is opposed to the horizontal transport of the basic sorter array 54.

In the embodiments illustrated in FIGS. 8 and 9, utilizing a copier wherein paper is fed out, with the copy surface up, in case of sequentially copying from the first page to the last page, when the copy number for the same document is 20 or less, the paper inverters 44, 51 are not used, and copies are sorted to the bins 26 of the basic sorter array 43 or 54. When the copy number is over 21, the copy is guided to a path for inverting operation by the paper path switching device 41 or 55 to collide against the inverting guide 46, 53, as the case may be, so that the copy is inverted through the respective inverter roll 45 or 52 and sorted to the bins 27 of the additional bin array 23 or 50.

Thus, in the embodiments illustrated in FIGS. 3 to 9, the additional bin array is coupled to the basic sorter array whereby even if the number of sorter bins is doubled, it is not necessary to provide the additional bin array with a horizontal transport and a vertical transport so that the manufacturing cost, the installation space and power consumption are not doubled, but reduced.

It will be apparent that the present invention, as described above, can accomplish a sorter which may not double the manufacturing cost, the installation space, and power consumption, but can reduce the same even if the number of paper storing positions is doubled, by interposing paper path switching means for distributing paper to a basic sorter array and an additional array of bins therebetween, and disposing a deflector gate for sorting paper to the basic sorter and the additional array of bins respectively, adjacent to a rotating and reversing transport.

While the invention has been described with reference to the structure disclosed, it is not confined to the details set forth, but is intended to cover such modifications or changes as may come within the scope of the following claims.

I claim:

1. A sheet sorting apparatus for a copier comprising a basic sorter array having vertically arranged bins, an additional array of vertically arranged bins, a sheet transport arranged to direct sheets from the copier to a discharge station, a vertical sheet transport arranged between said basic sorter and said additional array of bins, said vertical transport having first indexing means to selectively divert sheets to the bins of said basic sorter, and second indexing means to selectively divert sheets to the bins of said additional array, sheet path switching means adjacent said discharge station and arranged, when actuated to one control condition to divert sheets to said first indexing means and produce movement of sheets into the bins of said basic array, and when actuated to another control condition to divert sheets to said other indexing means and produce movement of sheets into the bins of said additional array.

2. The sorting apparatus of claim 1 including a sheet inverter positioned between said horizontal transport and said sheet path switching means for permitting the inversion of sheets before the sheets are diverted to either of said indexing means.

3. A sheet sorting apparatus for a copier comprising a sorter array having vertically arranged sheet collecting bins, a sheet transport arranged to direct sheets to a discharge station, a vertical sheet transport arranged along a side of said sorter array, said vertical transport having an indexing means to selectively divert sheets to the bins of said sorter, means for attaching an additional sorter array adjacent said sorter array, said additional array having a plurality of sheet collecting bins, said vertical transport having an additional indexing means arranged for selectively diverting sheets to the bins of said additional array, sheet path switching means adjacent said discharge station and arranged to divert sheets selectively to either of said indexing means and produce movement of sheets into the bins of the arrays, selectively, thereby permitting the use of additional sorting arrays.

* * * * *